US006071663A

United States Patent [19]

Matsuda et al.

[11] Patent Number: 6,071,663

[45] Date of Patent: Jun. 6, 2000

[54] CARRIER FOR ELECTROPHOTOGRAPHIC DEVELOPMENT AND ELECTROPHOTOGRAPHIC DEVELOPER CONTAINING THE SAME

[75] Inventors: Shinichi Matsuda; Yuji Sato; Hiromichi Kobayashi; Yasuhiko Kataoka; Tetsuya Uemura; Toshio Honjo, all of Kashiwa, Japan

[73] Assignee: Powdertech Co., Ltd., Chiba-ken, Japan

[21] Appl. No.: 09/220,377

[22] Filed: Dec. 24, 1998

[30] Foreign Application Priority Data

Dec. 26, 1997 [JP] Japan ..... 9-360880

[51] Int. Cl.[7] ..... G03G 9/10

[52] U.S. Cl. ..... 430/108; 430/137

[58] Field of Search ..... 430/108, 137

[56] References Cited

U.S. PATENT DOCUMENTS

| | | | |
|---|---|---|---|
| 5,342,721 | 8/1994 | Akamatsu | 430/108 |
| 5,885,741 | 3/1999 | Akamastu et al. | 430/108 |

FOREIGN PATENT DOCUMENTS

| | | |
|---|---|---|
| 64-59238 | 3/1989 | Japan . |
| 4-264563 | 9/1992 | Japan . |

*Primary Examiner*—John Goodrow
*Attorney, Agent, or Firm*—Young & Thompson

[57] ABSTRACT

A carrier for an electrophotographic developer comprising a carrier core coated with a silicone resin containing a crosslinking agent having a phenyl group.

9 Claims, 2 Drawing Sheets methylsilicone resin containing
crosslinking agent having phenyl group methylsilicone resin containing
crosslinking agent having methyl group methylphenylsilicone resin

CARRIER FOR ELECTROPHOTOGRAPHIC DEVELOPMENT AND ELECTROPHOTOGRAPHIC DEVELOPER CONTAINING THE SAME

BACKGROUND OF THE INVENTION

1. Field of the Invention

The present invention relates to a carrier for two-component electrophotographic developer used in copying machines and printers and to an electrophotographic developer containing the carrier.

2. Description of Related Art

A two-component developer used for developing an electrostatic latent image in electrophotography comprises a toner and a carrier. The carrier is mixed and agitated with the toner in a development box to give a desired charge to the toner and carries the charged toner onto an electrostatic latent image formed on a photosensitive material (photoreceptor) to form a toner image.

The carrier remains on the magnet and is returned to the development box where it is again mixed and agitated with fresh toner particles for repeated use.

In order to maintain high image quality over a service life of a developer in a stable manner, the carrier is required to have stable characteristics over the life.

Many of the state-of-the-art carriers for two-component dry developers for electrostatic latent image development have a resin coat for obtaining high image quality.

Because a developer is always under the stress of collisions among the particles or with the wall of a development box or a photoreceptor, etc. during the service life, the resin coat comes off the carrier core by the collisions. Further, the toner adheres to the surface of the carrier particles, that is, so-called spent phenomenon due to the heat generated by the collisions. It follows that the carrier characteristics are deteriorated with time, and it eventually comes necessary to exchange the developer for a new one.

In order to prevent deterioration of carrier characteristics, studies have been made on the resin to be used to coat the surface of a carrier. Of various resins proposed to date a silicone resin having a low surface tension has now been prevailing.

Carriers comprising a carrier core such as ferrite powder coated with a silicone resin and an electrophotographic developer containing such a silicone-coated carrier undergo great changes in chargeability and fluidity with environmental changes. In particular, the charge quantity decreases under a high temperature and high humidity condition to cause fog and increase of toner scattering, and the charge quantity increases in a low temperature and low humidity condition to cause a reduction in image density. Further, the fluidity varies with the environmental changes to impair conformity to a toner concentration sensor, which may lead to fatal image defects.

A phenylsilicone resin and a methylphenylsilicone resin have been proposed as a coating resin for stabilizing the chargeability of a carrier as disclosed in Japanese Patent Laid-Open Nos. 59238/89 and 264563/92, but they fail to bring about a solution to the above problem and have an additional disadvantage that the image characteristics largely vary during the service life.

SUMMARY OF THE INVENTION

Accordingly, an object of the present invention is to provide a carrier for an electrophotographic developer which is prevented from undergoing great changes in chargeability and fluidity with environmental changes, particularly showing little change in chargeability and fluidity in a high temperature and high humidity condition, and causes no reduction in image density nor image defects and to provide an electrophotographic developer containing such a carrier.

As a result of extensive study, the inventors of the present invention have found that the above object is accomplished by using a crosslinking agent having a phenyl group for a silicone resin to be used for coating a carrier core.

Having been completed based on the above finding, the present invention provides a carrier for an electrophotographic developer which comprises a carrier core coated with a silicone resin containing a crosslinking agent having a phenyl group.

The present invention also provides an electrophotographic developer comprising the above-described carrier and a toner.

The carrier for an electrophotographic developer according to the present invention shows little change in chargeability and fluidity with environmental changes, particularly under a high temperature and high humidity condition. The electrophotographic developer containing the carrier according to the present invention causes no reduction in image density nor image defects.

DETAILED DESCRIPTION OF THE INVENTION

Figure 1:
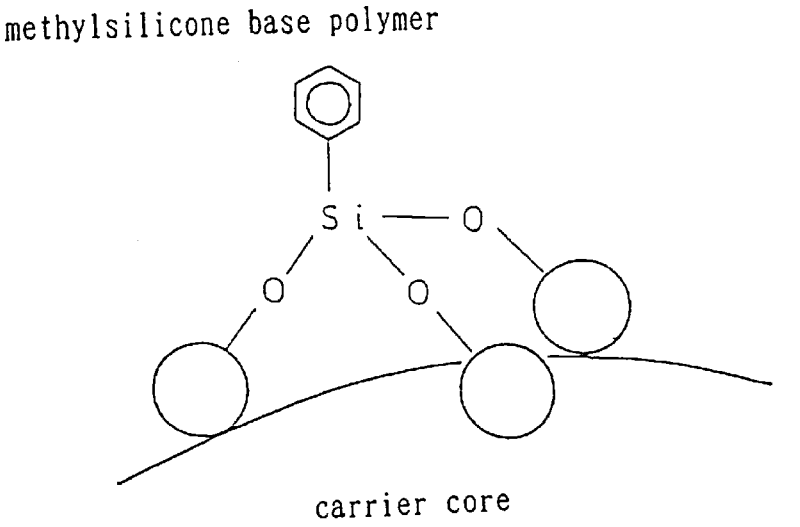
FIG. 1 is a schematic illustration showing adhesion of a methylsilicone resin containing a crosslinking agent having a phenyl group onto the surface of a carrier core.

In the present invention, a carrier core is coated with a silicone resin containing a crosslinking agent having a phenyl group.

The silicone resin which can be used in the present invention is not particularly limited and includes methylsilicone resins, methylphenylsilicone resins, and modified silicone resins such as acrylic-, epoxy-, urethane-, polyethylene- or alkyd-modified silicone resins. Room temperature curing silicone resins, particularly room temperature curing methylsilicone resins are preferred. The silicone resin may contain a silane coupling agent, conductive carbon, etc. for resistivity and chargeability control.

Crosslinking agents generally employed for room temperature curing silicone resins include the following 5 types and, in addition, tetrafunctional types corresponding to the 5 types having added thereto the free radical thereof. In the structural formulae shown below, R represents a methyl group, an allyl group, a phenyl group or a derivative thereof.

Alcohol Release Type:

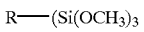

$$R—(Si(OCH_3)_3$$

Acetic Acid Release Type:

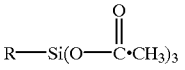

$$R—Si(O—\overset{\overset{\displaystyle O}{\|}}{C}\cdot CH_3)_3$$

Oxime Release Type:

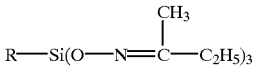

Amide Release Type:

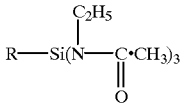

Acetone Release Type:

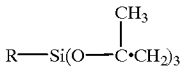

These crosslinking agents for room temperature curing silicone resins act on the terminal hydroxyl group of a silicone base polymer having a molecular weight of from several hundreds to several thousands, represented by formula:

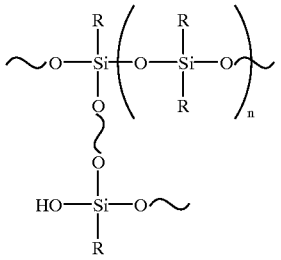

wherein R represents a hydrogen atom, a methoxy group, a phenyl group or a lower alkyl group having 1 to 4 carbon atoms, in the presence of a catalyst and water to provide a three dimensional crosslinked structure which is represented by, for example, the following formula.

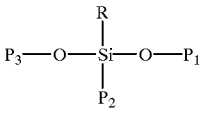

wherein $P_1$, $P_2$, and $P_3$ each represent a methylsilicone base polymer.

The crosslinking agent having a phenyl group which can be used in the present invention includes those represented by the above-described structural formulae in which R is a phenyl group. Preferred of them are the alcohol release type and the oxime release type. The alcohol release type is the most preferred for their reactivity.

The phenyl-containing crosslinking agent is preferably present in such an amount that the proportion of the total number of phenyl groups to the total number of functional groups R of the whole silicone resin as containing the crosslinking agent is 0.2 to 15%, particularly 1 to 8%, especially 1 to 5%. If the total phenyl group content is less than 0.2% in number, the effects expected of the presence of the phenyl group are not manifested. If it exceeds 15% in number, too large a phenyl group content impairs the fluidity and reduces the durability of the cured film.

In a two-component dry developer containing the carrier of the present invention, where a methylsilicone base polymer is crosslinked with the phenyl-containing crosslinking agent to form a coating layer on a carrier core, since the functional phenyl group of the phenyl-containing crosslinking agent is much bulkier than a methyl group, etc., the crosslinked silicone base polymer moieties are orientated to face the core with the phenyl groups facing outward as shown in FIG. 1 so as to avoid steric interference among them thereby forming a smooth coating layer. Besides, because the phenyl group has high lipophilic properties, it is capable of lessening the action of moisture on the silicone base polymer in a high temperature and high humidity environment. As a result, the changes in charge quantity and fluidity of a developer with environmental changes between an ambient temperature and ambient humidity environment and a high temperature and high humidity environment can be diminished.

Figure 2:
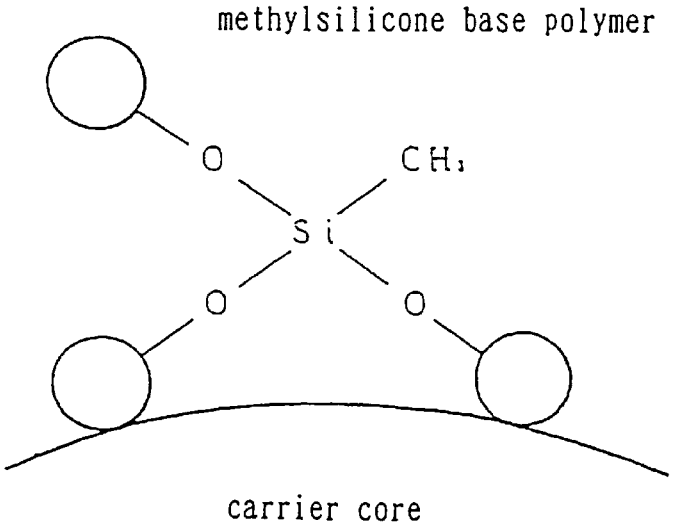
FIG. 2 is a schematic illustration showing the adhesion of a methylsilicone resin containing a crosslinking agent having a methyl group onto the surface of a carrier core.

On the other hand, in a coating layer of a methylsilicone polymer containing a conventional crosslinking agent having such a functional group as a methyl group, the functional group like a methyl group, being small, does not cause a great hinderance to the silicone base polymer. Therefore, the silicone base polymer is orientated in three dimensions to form a coating layer with unevenness as shown in FIG. 2. When the cured film is exposed in a high temperature and high humidity environment, it is very likely that the silicone base polymer is under direct influences of moisture, which leads to appreciable changes in charge quantity and fluidity of a developer with environmental changes between an ambient temperature and ambient humidity environment and a high temperature and high humidity environment.

Figure 3:
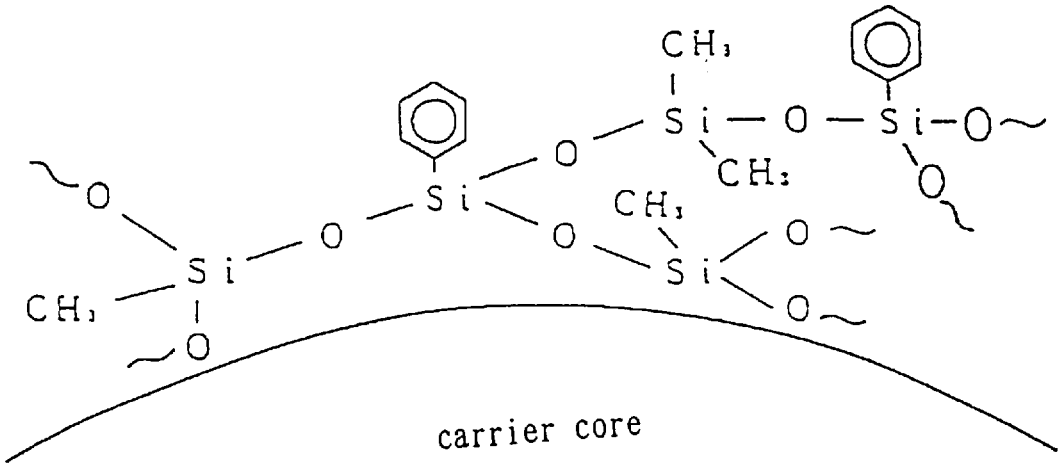
FIG. 3 is a schematic illustration showing the adhesion of a methylphenylsilicone resin onto the surface of a carrier core.

In cases where a methylphenylsilicone polymer is used as a coating resin, the phenyl groups are randomly disposed in a cured film so as to avoid the steric interference among themselves as shown in FIG. 3. As a result, the coating film is thick at the site having a high phenyl group content and thin at the site having a low phenyl group content, showing considerable unevenness as a whole. In this respect, a methylphenylsilicone polymer largely differs from a methylsilicone base polymer containing a phenyl-containing crosslinking agent. This being the case, the above-mentioned effects are not observed with a methylphenylsilicone polymer.

The carrier core material used in the present invention is not particularly limited and includes iron powder, ferrite powder, and magnetite powder. Ferrite powder comprising Cu, Zn, Mg, Mn, Ca, Li, Sr, Sn, Ni, Al, Ba, Co, etc. is preferred. The carrier core is not limited in shape, surface properties, particle size, magnetic characteristics, resistivity, chargeability, and the like.

The coating weight of the silicone resin on the core is preferably 0.05 to 10.0% by weight, still preferably 0.1 to 7.0% by weight, based on the core.

Coating of the core with the silicone resin is usually carried out by a wet process comprising applying the silicone resin as diluted with a solvent onto the surface of the core. Any solvent capable of dissolving the silicone resin is employable. Suitable solvents include toluene, xylene, cellosolve butyl acetate, methyl ethyl ketone, methyl isobutyl ketone, and methanol. The resin diluted with the solvent is applied to the core by dip coating, spraying, brush coating, kneading or a like technique, and the solvent is then evaporated. A dry process comprising coating the core with a powdered resin is also effective.

After coating, the coating layer can be baked, if desired, either by external heating or internal heating by means of, for example, a fixed bed or fluidized bed electric oven, a rotary kiln type electric oven, a burner oven, or a microwave oven. The baking temperature depends on the silicone resin and should be raised up to a point at which curing by crosslinking proceeds sufficiently.

The core thus coated with the silicone resin and baked is cooled, ground, and regulated in size to obtain a silicone resin-coated carrier.

The carrier according to the present invention is mixed with a toner to provide a tow-component developer for electrophotography. The toner to be used comprises a binder resin having dispersed therein a charge control agent, a colorant, etc.

While not limiting, the binder resin which can be used in the toner includes polystyrene, chloropolystyrene, a styrene-chlorostyrene copolymer, a styrene-acrylate copolymer, a styrene-methacrylic acid copolymer, a rosin-modified maleic acid resin, an epoxy resin, a polyester resin, a polyethylene resin, a polypropylene resin, and a polyurethane resin. These binder resins can be used either individually or as a mixture thereof.

The charge control agent to be used in the toner is selected arbitrarily. Useful charge control agents for positively chargeable toners include nigrosine dyes and quaternary ammonium salts, and those for negatively chargeable toners include metallized monoazo dyes.

Any known dyes and pigments are useful as a colorant. Examples of suitable colorants are carbon black, Phthalocyanine Blue, Permanent Red, Chrome Yellow, and Phthalocyanine Green. The toner can further contain external additives, such as fine silica powder and titania, for improvement on fluidity and anti-agglomeration.

The method for preparing the toner is not particularly restricted. For example, a binder resin, a charge control agent and a colorant are dry blended thoroughly in a mixing machine, e.g., a Henschel mixer, and the blend is melt-kneaded in, e.g., a twin-screw extruder. After cooling, the mixture is ground, classified, and mixed with necessary additives in a mixing machine, etc.

The carrier according to the present invention is particularly effective when mixed with a polyester-based toner and used in a reversal development system using a photoreceptor made of an organic photoconductor.

The present invention will now be illustrated in greater detail with reference to Examples. Unless otherwise noted, all the percents are by weight.

EXAMPLE 1

A methylsilicone resin containing trimethoxyphenylsilane as a crosslinking agent in such an amount as to give a phenyl group content of 3% in number based on the total number of functional groups R of the whole silicone resin was mixed with 15%, on the solid content of the resin, of an aminosilane coupling agent (3-aminopropyltriethoxysilane) and 11.25%, on the solid content of the resin, of carbon black (Ketjenblack EC-600 JD, produced by Ketjenblack International Company) to prepare resin 1.

Manganese ferrite particles (core) having an average particle size of 90 $\mu$m was coated with 0.7% of resin 1 and baked at 260° C. for 2 hours to obtain carrier 1.

EXAMPLE 2

Resin 2 was prepared in the same manner as for resin 1 except that the phenyl group content was 1.2% in number based on the total number of the functional groups R of the whole silicone resin. Carrier 2 was obtained in the same manner as in Example 1 except for using resin 2.

EXAMPLE 3

Resin 3 was prepared in the same manner as for resin 1 except that the phenyl group content was 5% in number based on the total number of the functional groups R of the whole silicone resin. Carrier 3 was obtained in the same manner as in Example 1 except for using resin 3.

EXAMPLE 4

Resin 4 was prepared in the same manner as for resin 1 except that the phenyl group content was 10% in number based on the total number of the functional groups R of the whole silicone resin. Carrier 4 was obtained in the same manner as in Example 1 except for using resin 4.

EXAMPLE 5

Resin 5 was prepared in the same manner as in Example 1, except for using a methylsilicone resin containing tri (ethylmethylketoxime)phenylsilane as a crosslinking agent in such an amount as to give a phenyl group content of 17% in number based on the total number of functional groups R of the whole silicone resin. Carrier 5 was obtained in the same manner as in Example 1 except for using resin 5.

Comparative Example 1

Resin 6 was prepared in the same manner as in Example 1, except for using a heat curing methylsilicone resin containing no phenyl-containing crosslinking agent. Carrier 6 was prepared in the same manner as in Example 1, except for using resin 6.

Comparative Example 2

Resin 7 was prepared in the same manner as in Example 1, except for using a methylsilicone resin containing a crosslinking agent having a methyl group. Carrier 7 was prepared in the same manner as in Example 1, except for using resin 7.

Comparative Example 3

Resin 8 was prepared in the same manner as in Example 1, except for using a methylphenylsilicone resin containing a crosslinking agent having a methyl group, the phenyl group content of the whole silicone resin being 40% in number based on the total number of functional groups R of the whole silicone resin. Carrier 8 was prepared in the same manner as in Example 1, except for using resin 8.

Evaluation

Each of the carriers 1 to 8 obtained in Examples 1 to 5 and Comparative Examples 1 to 3 was mixed with a polyester-based toner to prepare a two-component developer having a top sheet density of 4%. The charge quantity of the developer was measured under an ambient temperature and ambient humidity condition (23° C., 60% RH) and a high temperature and high humidity condition (35° C., 85% RH), and the reading of a toner concentration sensor, fitted to a commercially available copier AR-5130 manufactured by Sharp Corp., was taken under each condition. Further, the changes of the charge quantity and the sensor reading from the ambient temperature and ambient humidity condition to the high temperature and high humidity condition were calculated. Then, a copying test was carried out on that copier to confirm durability of the developer. The results obtained are shown in Table 1 below. The durability of the developers was evaluated in terms of the number of copies obtained that satisfied the conditions of 1.3 or more in image density, 0.8 or less in fog on the white background, and 180 g or less in toner consumption per 5000 copies, and rated as follows.

A . . . 150,000 or more copies

B . . . 120,000 or more copies

C . . . 80,000 or more copies

D . . . Less than 80,000 copies

TABLE 1

| | Example No. | | | | | Compara. Example No. | | |
|---|---|---|---|---|---|---|---|---|
| | 1 | 2 | 3 | 4 | 5 | 1 | 2 | 3 |
| Carrier No. | 1 | 2 | 3 | 4 | 5 | 6 | 7 | 8 |
| 23+ C., 60% RH (A) | | | | | | | | |
| Charge Quantity (° C./g) | 13.6 | 12.8 | 13.9 | 14.3 | 14.7 | 11.5 | 13.9 | 15.3 |
| Sensor Reading | 47 | 35 | 53 | 58 | 46 | 5 | 8 | 33 |
| 35° C., 85% RH (B) | | | | | | | | |
| Charge Quantity (° C./g) | 12.9 | 11.9 | 13.3 | 12.8 | 12.7 | 8.3 | 9.5 | 11.6 |
| Sensor Reading | 53 | 44 | 60 | 71 | 66 | 42 | 40 | 74 |
| (A) → (B) | | | | | | | | |
| Charge Quantity (° C./g) | −0.7 | −0.9 | −0.6 | −1.5 | −2.0 | −3.2 | −4.4 | −3.7 |
| Sensor Reading | 6 | 9 | 7 | 13 | 20 | 37 | 32 | 41 |
| Durability of Developer | A | A | A | B | C | D | D | D |

As is shown in Table 1 above, Examples 1 to 5 show smaller changes in charge quantity and reading of the toner concentration sensor with the environmental change and achieve longer durability than Comparative Examples 1 to 3.

What is claimed is:

1. A carrier for an electrophotographic developer comprising a carrier core coated with a silicone resin containing a crosslinking agent having a phenyl group.

2. The carrier according to claim 1, wherein said silicone resin is a room temperature curing silicone resin.

3. The carrier according to claim 1, wherein the total proportion of the phenyl group of said crosslinking agent to the total functional groups in said silicone resin as containing the crosslinking agent is 0.2 to 15% in number.

4. The carrier according to claim 2, wherein said silicone resin is a methylsilicone resin.

5. An electrophotographic developer comprising a toner and the carrier according to claim 1.

6. A carrier for an electrophotographic developer comprising a carrier core coated with a room temperature curing methylsilicone resin containing trimethoxyphenylsilane as a cross-linking agent in such an amount that the proportion of total number of phenyl groups to the total number of functional groups in the methylsilicone resin is 0.2 to 15% in number.

7. The carrier according to claim 6, wherein the proportion of total number of phenyl groups to the total of number of functional groups in the methylsilicone resin is 1 to 8%.

8. The carrier according to claim 6, wherein the proportion of total number of phenyl groups to the total of number of functional groups in the methylsilicone resin is 1 to 5%.

9. An electrophotographic developer comprising a toner and the carrier according to claim 6.

* * * * *